US011522329B2

(12) United States Patent
Sato et al.

(10) Patent No.: US 11,522,329 B2
(45) Date of Patent: Dec. 6, 2022

(54) TERMINAL-WIRE BONDING METHOD AND BONDED TERMINAL-WIRE

(71) Applicant: Yazaki Corporation, Tokyo (JP)

(72) Inventors: Tomoya Sato, Shizuoka (JP); Hiroshi Aoki, Shizuoka (JP); Naoki Ito, Shizuoka (JP); Yasunori Nabeta, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 57 days.

(21) Appl. No.: 16/572,761

(22) Filed: Sep. 17, 2019

(65) Prior Publication Data

US 2020/0091670 A1 Mar. 19, 2020

(30) Foreign Application Priority Data

Sep. 18, 2018 (JP) ..... JP2018-173638

(51) Int. Cl.

| | |
|---|---|
| ***H01R 43/02*** | (2006.01) |
| ***H01R 4/02*** | (2006.01) |
| ***H01R 12/57*** | (2011.01) |
| ***H01R 4/72*** | (2006.01) |
| ***H01R 4/18*** | (2006.01) |

(52) U.S. Cl.

CPC ..... *H01R 43/0207* (2013.01); *H01R 4/021* (2013.01); *H01R 4/023* (2013.01); *H01R 4/029* (2013.01); *H01R 4/184* (2013.01); *H01R 4/72* (2013.01); *H01R 12/57* (2013.01)

(58) Field of Classification Search

CPC .... H01R 43/0207; H01R 4/021; H01R 4/023; H01R 4/029; H01R 4/184; H01R 4/72; H01R 12/57

See application file for complete search history.

(56) References Cited

U.S. PATENT DOCUMENTS

| | | | | |
|---|---|---|---|---|
| 7,744,395 | B1 * | 6/2010 | Cantolino | H01R 13/52 439/279 |
| 10,276,283 | B2 * | 4/2019 | Nabeta | H01B 5/08 |
| 10,511,105 | B2 * | 12/2019 | Sato | H01R 4/027 |
| 10,559,896 | B2 * | 2/2020 | Sato | H01R 43/048 |
| 2004/0088857 | A1 * | 5/2004 | Fujimoto | H01R 43/0207 29/871 |
| 2012/0318554 | A1 | 12/2012 | Koto | |

(Continued)

FOREIGN PATENT DOCUMENTS

| | | |
|---|---|---|
| JP | 0982375 A | 3/1997 |
| JP | 2012014975 A | 1/2012 |

(Continued)

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A terminal-wire bonding method includes: arranging a first core at a second end of a first terminal-wire having a first terminal connected with the first core exposed from an insulating sheath at a first end, onto a side of an anvil and a second core at a second end of a second terminal-wire having a second terminal connected with the second core exposed, at a first end, from an insulating sheath longer than the insulating sheath of the first terminal-wire, onto a side of a horn; and bonding the first core at the second end and the second core at the second end together by ultrasonic bonding between the horn and the anvil.

9 Claims, 7 Drawing Sheets

(56) References Cited

U.S. PATENT DOCUMENTS

| | | | | |
|---|---|---|---|---|
| 2013/0000949 | A1* | 1/2013 | Torimoto | B23K 20/106<br>174/113 R |
| 2019/0165533 | A1* | 5/2019 | Nabeta | B23K 20/10 |
| 2020/0091670 | A1* | 3/2020 | Sato | H01R 4/184 |
| 2020/0091691 | A1* | 3/2020 | Sato | H01R 4/625 |

FOREIGN PATENT DOCUMENTS

| | | | |
|---|---|---|---|
| JP | 2013004346 | A | 1/2013 |
| JP | 2013-118196 | A | 6/2013 |
| JP | 2016185009 | A | 10/2016 |
| JP | 2016-201313 | A | 12/2016 |

* cited by examiner

TERMINAL-WIRE BONDING METHOD AND BONDED TERMINAL-WIRE

CROSS REFERENCE TO RELATED APPLICATIONS

The present application claims priority to Japanese Patent Application No. 2018-173638 filed on Sep. 18, 2018, the entire contents of which are incorporated by reference herein.

BACKGROUND

Technical Field

The present invention relates to a terminal-wire (terminal wire) bonding method of ultrasonically connecting exposed cores of a plurality of wires together and a bonded terminal-wire (terminal wire).

Related Art

An example of this type of wire connecting method is disclosed in JP 2013-118196 A. As illustrated in FIGS. 10A and 10B, the wire connecting method includes: peeling respective insulating sheaths of a wire 1 and an ultrafine wire 2 to expose cores (conductors) 1*a* and 2*a* (preparing); as illustrated in FIG. 10A, pinching the exposed cores 1*a* and 2*a* of the wire 1 and the ultrafine wire 2 with a horn 6 and an anvil 8 to pressurize the exposed cores 1*a* and 2*a*, and, as illustrated in FIG. 10B, ultrasonically bonding the cores 1*a* and 2*a* of the wire 1 and the ultrafine wire 2 together by ultrasonic vibration energy smaller than ultrasonic vibration energy at bonding, to acquire a temporarily bonded body 3 (temporary bonding); and ultrasonically re-bonding the temporarily bonded body 3 acquired at the temporary bonding, by the ultrasonic vibration energy larger than the ultrasonic vibration energy at the temporary bonding, resulting in completion.

The ultrafine wire 2 close to the anvil 8 at the ultrasonic bonding during the bonding, is less likely to break due to contact with the horn 6, so that the ultrafine wire 2 can be ultrasonically bonded with the possibility of cutting reduced.

SUMMARY

However, the conventional wire connecting method requires the temporary bonding after the preparing but before the bonding, resulting in a rise in the number of steps and a rise in cost. In addition, the core 2*a* that bonds to the core 1*a* of the other wire 1, is likely to be damaged, such as breaking.

Thus, the present invention has been made in order to solve the problem, and an object of the present invention is to provide a terminal-wire bonding method capable of bonding cores of a plurality of wires together simply at low cost without breaking, the terminal-wire bonding method enabling inhibition of a terminal connected with an end of each wire, from being damaged, such as breaking, and a bonded terminal-wire.

According to an aspect of the present invention, provided is a terminal-wire bonding method with a first terminal-wire and a second terminal-wire, the first terminal-wire having a first terminal connected with a first core exposed from an insulating sheath at a first end, the first core being exposed from the insulating sheath at a second end of the first terminal-wire, the second terminal-wire having a second terminal connected with a second core exposed, at a first end, from an insulating sheath longer than the insulating sheath of the first terminal-wire, the second core being exposed from the insulating sheath longer than the insulating sheath of the first terminal-wire, at a second end of the second terminal-wire, the terminal-wire bonding method including: arranging the second core at the second end onto a side of a horn for ultrasonic bonding and the first core at the second end onto a side of an anvil for ultrasonic bonding; and bonding the first core at the second end and the second core at the second end together by ultrasonic bonding between the horn and the anvil.

According to an aspect of the present invention, provided is a bonded terminal-wire including: a first terminal-wire having a first terminal connected with a first core including a plurality of strands exposed from an insulating sheath at a first end, the first core being exposed from the insulating sheath at a second end of the first terminal-wire; and a second terminal-wire having a second terminal connected with a second core including a plurality of strands exposed, at a first end, from an insulating sheath longer than the insulating sheath of the first terminal-wire, the plurality of strands each being identical in thickness to each strand of the first core, the second core being exposed from the insulating sheath longer than the insulating sheath of the first terminal-wire, at a second end of the second terminal-wire, in which the first core at the second end and the second core at the second end are bonded together by ultrasonic bonding between a horn and an anvil for ultrasonic bonding with the second core at the second end arranged on a side of the horn and the first core at the second end arranged on a side of the anvil, and the plurality of strands of the second core at the second end on the side of the horn is bonded with collapse stronger than collapse of the plurality of strands of the first core at the second end on the side of the anvil.

According to the present invention, the number of steps can be reduced in comparison to the conventional method, and the first core at the second end of the first terminal-wire and the second core at the second end of the second terminal-wire can be bonded together simply at low cost. In addition, the first end of each wire can receive weak vibration at ultrasonic bonding, so that the first terminal at the first end of the first terminal-wire can be inhibited from being damaged, such as breaking.

DETAILED DESCRIPTION

Embodiments of the present invention will be described below on the basis of the drawings.

Figure 1A:
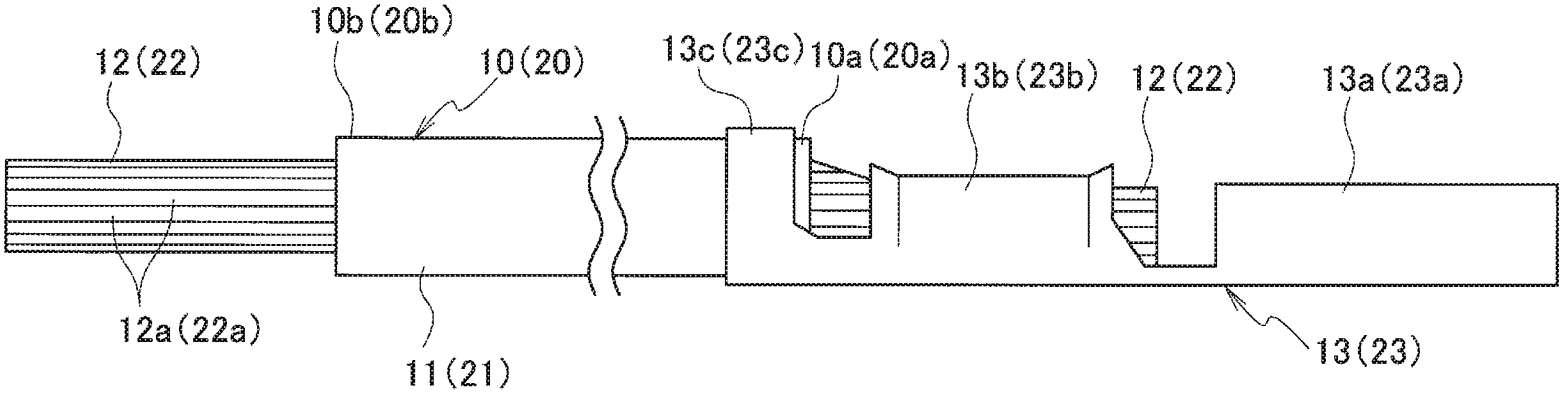
FIG. 1A is a side view of a terminal-wire having an insulating sheath peeled at each end, used in a terminal-wire bonding method according to a first embodiment of the present invention.
Figure 1B:
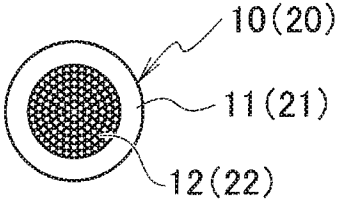
FIG. 1B is a front view of the terminal-wire.
Figure 2:
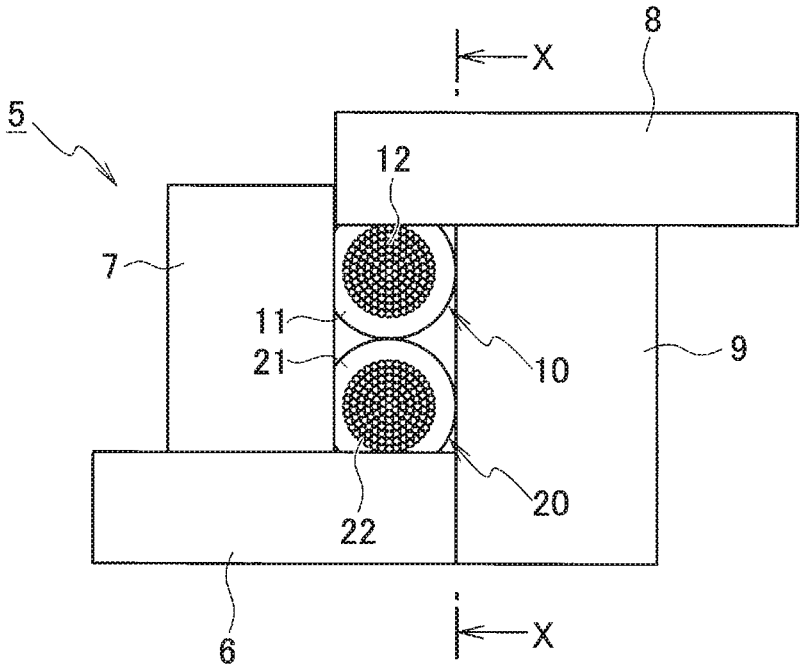
FIG. 2 is a front view of two different-length terminal-wires set between a horn and an anvil in an ultrasonic bonder used in the terminal-wire bonding method according to the first embodiment.
Figure 3:
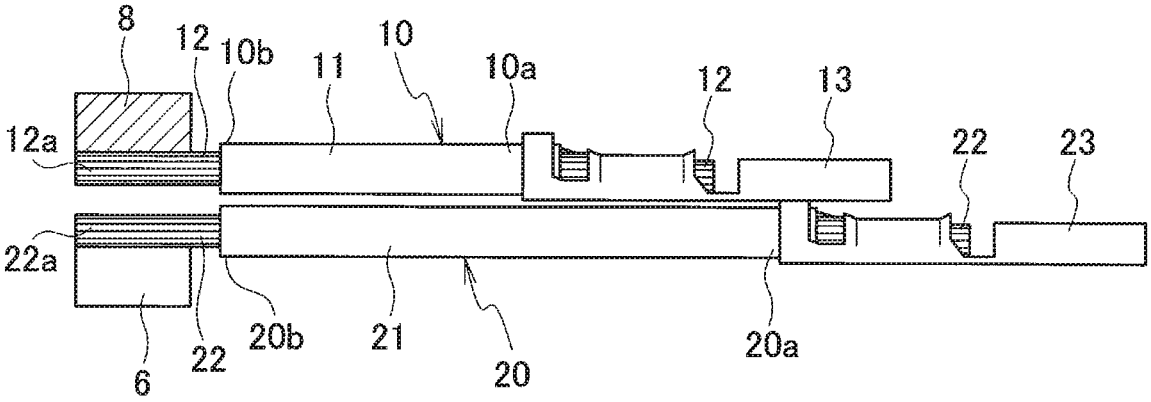
FIG. 3 is a sectional view taken along line X-X of FIG. 2.
Figure 4:
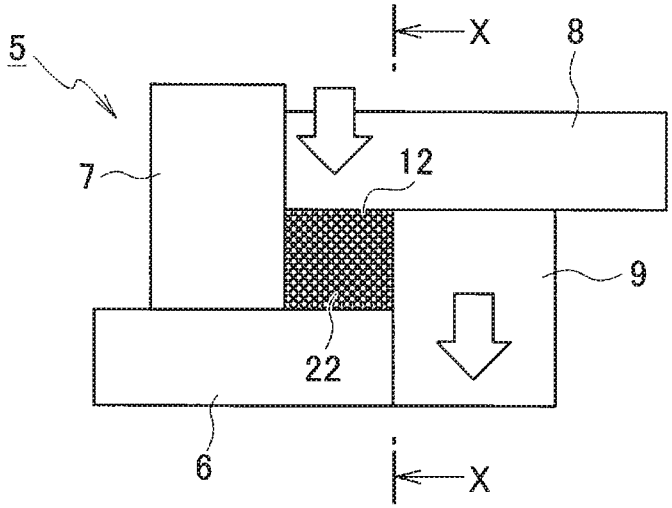
FIG. 4 is a front view of the two different-length terminal-wires bonded together between the horn and the anvil in the ultrasonic bonder.
Figure 5A:
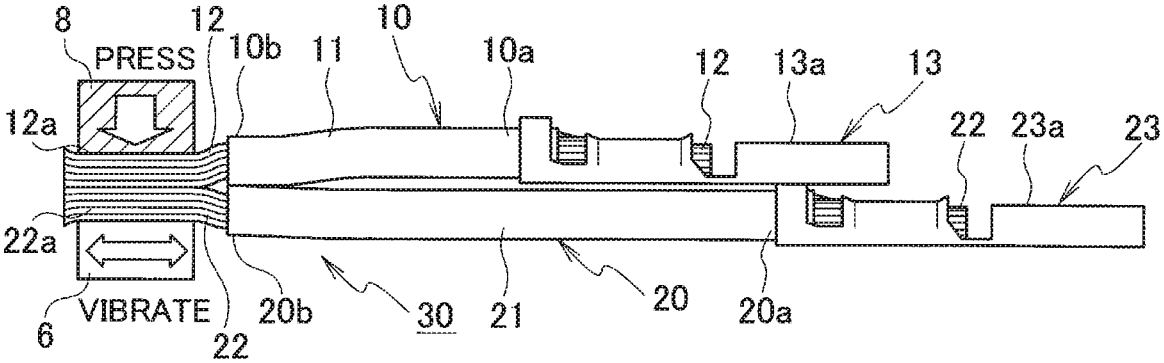
FIG. 5A is a sectional view taken along line X-X of FIG. 4.
Figure 5B:
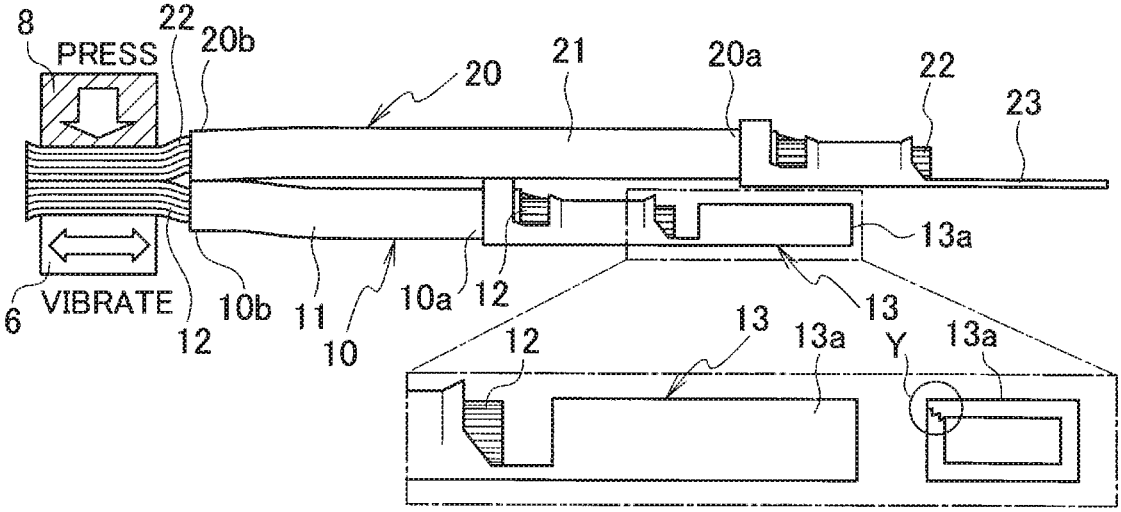
FIG. 5B is a sectional view taken along line X-X of FIG. 4 according to an comparative example.
Figure 6A:
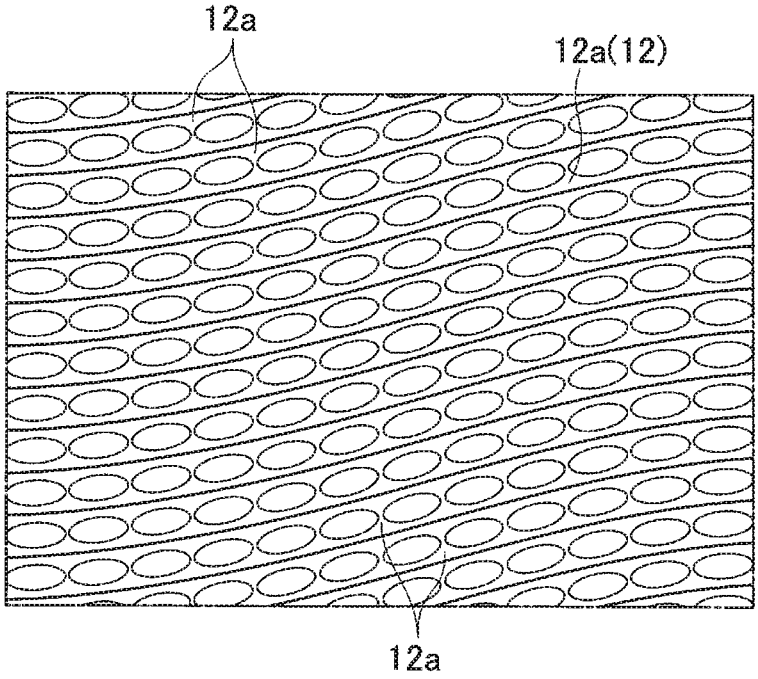
FIG. 6A is an explanatory view of the bonded state of a plurality of strands in a core located on the side of the anvil.
Figure 6B:
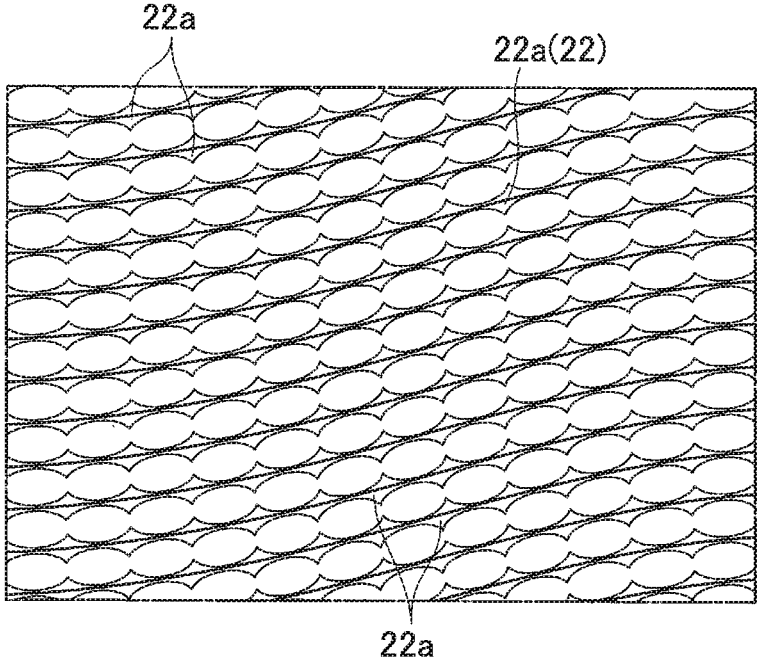
FIG. 6B is an explanatory view of the bonded state of a plurality of strands in a core located on the side of the horn.

FIG. 1A is a side view of a terminal-wire (terminal wire) having an insulating sheath peeled at each end, used in a terminal-wire bonding method according to a first embodiment of the present invention, and FIG. 1B is a front view of the terminal-wire. FIG. 2 is a front view of two different-length terminal-wires set between a horn and an anvil in an ultrasonic bonder used in the terminal-wire bonding method. FIG. 3 is a sectional view taken along line X-X of FIG. 2. FIG. 4 is a front view of the two different-length terminal-wires bonded together between the horn and the anvil. FIG. 5A is a sectional view taken along line X-X of FIG. 4, and FIG. 5B is a sectional view taken along line X-X of FIG. 4 according to an comparative example. FIG. 6A is an explanatory view of the bonded state of a plurality of strands in a core located on the side of the anvil, and FIG. 6B is an explanatory view of the bonded state of a plurality of strands in a core located on the side of the horn.

As illustrated in FIGS. 1A and 1B, in the terminal-wire bonding method according to the first embodiment, prepared are two different-length wires of a first terminal-wire (terminal wire) 10 and a second terminal-wire (terminal wire) 20 each having a terminal connected with a core (conductor) exposed from an insulating sheath at a first end of the wire. As illustrated in FIGS. 2 and 4, with the ultrasonic bonder 5 including the horn 6 for giving ultrasonic vibration, a grinding jaw 7, the anvil 8 for pressurization that receives a portion to be processed, and an anvil plate 9, the first core 12 of the first terminal-wire 10 and the second core 22 of the second terminal-wire 20 are bonded together by ultrasonic bonding between the horn 6 and the anvil 8. That is, as illustrated in FIGS. 3 and 5A, the first terminal-wire 10 having the crimp terminal (first terminal) 13 connected with the first core 12 including a plurality of strands 12*a* exposed, at the first end 10*a*, from the insulating sheath 11 shorter in length (shorter in wire length) than the insulating sheath 21 of the second terminal-wire 20 and the second terminal-wire 20 having the crimp terminal (second terminal) 23 connected with the second core 22 including a plurality of strands 22*a* exposed, at the first end 20*a*, from the insulating sheath 21 longer in length (longer in wire length) than the insulating sheath 11 of the first terminal-wire 10, each strand 22*a* being identical in thickness to each strand 12*a* of the first core 12, are used. The first core 12 exposed, at the second end 10*b* of the first terminal-wire 10, from the insulating sheath 11 shorter in length than the insulating sheath 21 of the second terminal-wire 20 and the second core 22 exposed, at the second end 20*b* of the second terminal-wire 20, from the insulating sheath 21 longer in length than the insulating sheath 11 of the first terminal-wire 10, are bonded together by ultrasonic bonding between the horn 6 and the anvil 8 of the ultrasonic bonder 5.

The respective cores 12 and 22 of the first terminal-wire 10 and the second terminal-wire 20 that bond together are identical in material and in sectional area. Examples of the material of the cores 12 and 22 include aluminum, aluminum alloy, copper, copper alloy, a tinned copper, and aluminum doped with carbon nanotubes. The cores 12 and 22 each may be a stranded conductor or a single core.

As illustrated in FIGS. 1A and 1B, the crimp terminal 13 and the crimp terminal 23 made of metal are crimp-connected with the first core 12 and the second core 22 at the first end 10*a* and the first end 20*a* of the first terminal-wire 10 and the second terminal-wire 20, respectively. The crimp terminal 13 includes a box-shaped terminal connector 13*a* to be electrically connected with a mating terminal, at the front, a core barrel 13*b* crimped to the first core 12 exposed from the insulating sheath 11, at the center, and a sheath barrel 13*c* crimped to the insulating sheath 11, at the rear. The crimp terminal 23 includes a box-shaped terminal connector 23*a* to be electrically connected with a mating terminal, at the front, a core barrel 23*b* crimped to the second core 22 exposed from the insulating sheath 21, at the center, and a sheath barrel 23*c* crimped to the insulating sheath 21, at the rear.

Next, the terminal-wire bonding method according to the first embodiment will be described. As illustrated in FIGS. 2 and 3, first, the second core 22 exposed from the insulating sheath 21 at the second end 20*b* of the second terminal-wire 20 longer in wire length, is arranged on the side of the horn 6 of the ultrasonic bonder 5 and the first core 12 exposed from the insulating sheath 11 at the second end 10*b* of the first terminal-wire 10 shorter in wire length, is arranged on the side of the anvil 8 such that the first core 12 and the second core 22 identical in orientation overlap (setting).

Next, as illustrated in FIGS. 4 and 5A, the second core 22 exposed from the insulating sheath 21 at the second end 20*b* of the second terminal-wire 20 longer in wire length and the first core 12 exposed from the insulating sheath 11 at the second end 10*b* of the first terminal-wire shorter in wire length, are bonded together by ultrasonic bonding with the ultrasonic vibration of the horn 6 and the pressurization of the anvil 8 between the horn 6 and the anvil 8 (bonding).

At this time, the ultrasonic vibration oscillated from the horn 6 travels from the second end 20*b* to the second terminal-wire 20 and then propagates to the first end 20*a* while damping in the second terminal-wire 20. The vibration of the horn 6 propagates to the anvil 8 while damping. The first terminal-wire 10 shorter in wire length arranged on the side of the anvil 8, receives the vibration damped more than that of the second terminal-wire 20 longer in wire length on the side of the horn 6, and thus the vibration that travels to the first end 10*a* weakens. Thus, the first core 12 exposed from the insulating sheath 11 of the first terminal-wire 10 shorter in wire length, receive less damage, such as breaking. The second terminal-wire 20 longer in wire length arranged on the side of horn 6, causes the vibration received from the horn 6, to damp in the second terminal-wire 20, so that the vibration that travels to the first end 20*a* weakens.

That is, as the comparative example illustrated in FIG. 5B, ultrasonic bonding of a first core 12 of a first terminal-wire (terminal wire) 10 shorter in wire length arranged on the side of the horn 6 and a second core 22 of a second terminal-wire (terminal wire) 20 longer in wire length arranged on the side of the anvil 8, together, causes, for example, a bent portion (portion indicated with reference sign Y in the figure) of a box-shaped terminal connector 13*a* of a crimp terminal 13 connected with the first core 12 at a first end 10*a* of the first terminal-wire 10 shorter in wire length, to be likely to be damaged, such as breaking. Because the strength of a bonded portion of the first core 12 at a second end 10*b* and a second core 22 at a second end 20*b* depends on the strength of the first terminal-wire 10 shorter in wire length, in the bonded portion, when the first core 12 of the first terminal-wire 10 shorter in wire length is damaged, the strength of the bonded portion deteriorates. According to the first embodiment, provided are the setting in which the second core 22 at the second end 20*b* of the second terminal-wire 20 longer in wire length is arranged on the side of the horn 6 and the first core 12 at the second end 10*b* of the first terminal-wire 10 shorter in wire length is arranged on the side of the anvil 8, and the bonding in which the first core 12 at second end 10*b* and the second core 22 at the second end 20*b* are bonded together by ultrasonic bonding between the horn 6 and the anvil 8. Thus, the number of steps can be reduced in comparison to the conventional method, and the two cores 12 and 22 can be bonded simply at low cost without breaking (particularly, the first core 12 shorter in wire length). In addition, in comparison to the comparative example illustrated in FIG. 5B, the first end 10*a* of the first terminal-wire 10 shorter in wire length can receive weak vibration at ultrasonic bonding. Thus, the box-shaped terminal connector 13*a* of the crimp terminal 13 at the first end 10*a* of the first terminal-wire 10 shorter in wire length, can be inhibited from being damaged, such as breaking. Similarly, the box-shaped terminal connector 23*a* of the crimp terminal 23 at the first end 20*a* of the second terminal-wire 20 longer in wire length, can be inhibited from being damaged, such as breaking.

As illustrated in FIG. 5A, the horn 6 propagates ultrasonic vibration energy between the plurality of strands 12*a* of the first core 12 at the second end 10*b* of the first terminal-wire 10 shorter in wire length and the plurality of strands 22*a* of the second core 22 at the second end 20*b* of the second terminal-wire 20 longer in wire length. Then, the ultrasonic vibration energy destroys and removes, for example, respective oxide films on the surfaces of the strands 12*a* and 22*a*, so that a bonded terminal-wire (terminal wire) 30 ultrasonically bonded is acquired. In the bonded terminal-wire 30, the plurality of strands 22*a* of the second core 22 at the second end 20*b* on the side of the horn 6 as illustrated in FIG. 6B is bonded with collapse stronger than that of the plurality of strands 12*a* of the first core 12 at the second end 10*b* on the side of the anvil 8 illustrated in FIG. 6A.

As described above, the arrangement and bonding of the first core 12 at the second end 10*b* of the first terminal-wire 10 shorter in wire length, on the side of the anvil 8, enables the cores 12 and 22 at the first ends 10*a* and 20*a* of the wires 10 and 20 (crimp terminals 13 and 23) to receive less vibration. In addition, the first terminal-wire 10 and the second terminal-wire 20 can be bonded together with the first terminal-wire 10 shorter in wire length, inhibited from being damaged, as much as possible.

Figure 7:
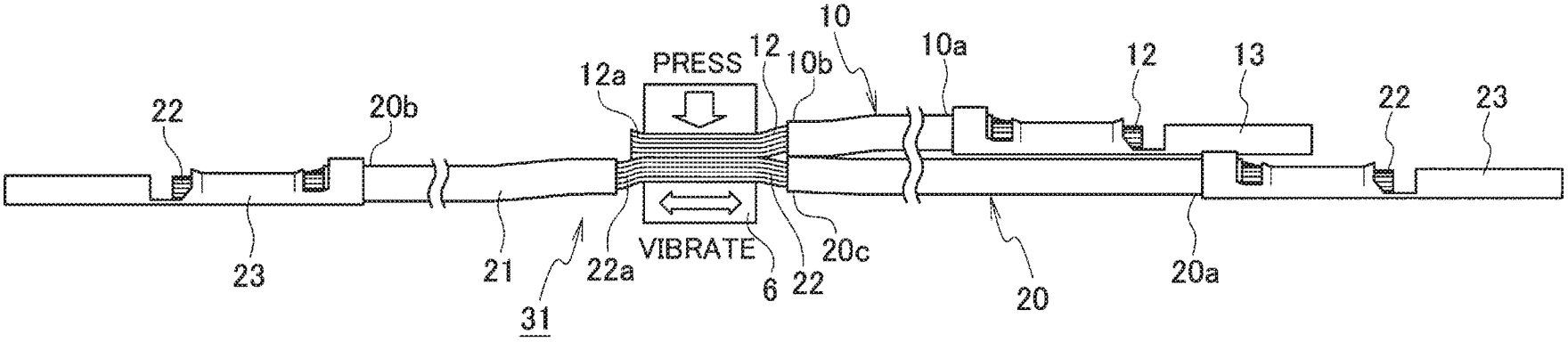
FIG. 7 is a side view of two different-length terminal-wires bonded together at an intermediate portion of one of the two terminal-wires and an end of the other terminal-wire, according to a second embodiment of the present invention.

FIG. 7 is a side view of two different length terminal-wires bonded together at an intermediate portion of one of the two terminal-wires and an end of the other terminal-wire, according to a second embodiment of the present invention.

A terminal-wire bonding method according to the second embodiment is different from that according to the first embodiment in that a second core 22 exposed by peeling of an intermediate 20*c* of an insulating sheath 21 of a second terminal-wire 20 longer in wire length and a first core 12 exposed from an insulating sheath 11 at a second end 10*b* of a first terminal-wire 10 shorter in wire length are ultrasonically bonded together. Note that the other configurations are similar to those according to the first embodiment. Thus, the same constituent elements are denoted with the same reference signs, and the detailed descriptions thereof will be omitted.

The terminal-wire bonding method according to the second embodiment will be described. At setting, the second core 22 exposed by intermediate peeling of the insulating sheath 21 of the second terminal-wire 20 longer in wire length is arranged on the side of a horn 6, and the first core 12 exposed from the insulating sheath 11 at the second end 10*b* of the first terminal-wire 10 shorter in wire length is arranged on the side of an anvil 8. At bonding, the second core 22 exposed by the intermediate peeling of the insulating sheath 21 of the second terminal-wire 20 longer in wire length and the first core 12 exposed from the insulating sheath 11 at the second end 10*b* of the first terminal-wire 10 shorter in wire length, are bonded together by ultrasonic bonding between the horn 6 and the anvil 8. Thus, a bonded terminal-wire 31 illustrated in FIG. 7 is completed, and function and effect similar to those according to the first embodiment are achieved.

Figure 8:
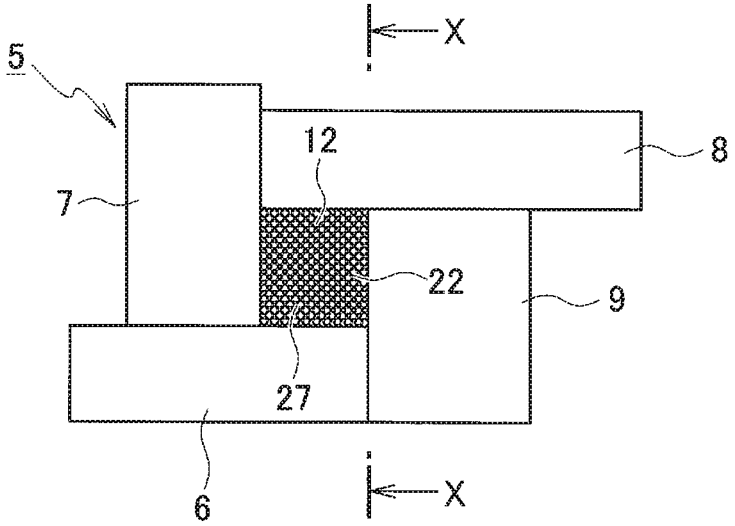
FIG. 8 is a front view of two different-length terminal-wires and a dummy wire bonded together between a horn and an anvil in an ultrasonic bonder used in a terminal-wire bonding method according to a third embodiment of the present invention.
Figure 9:
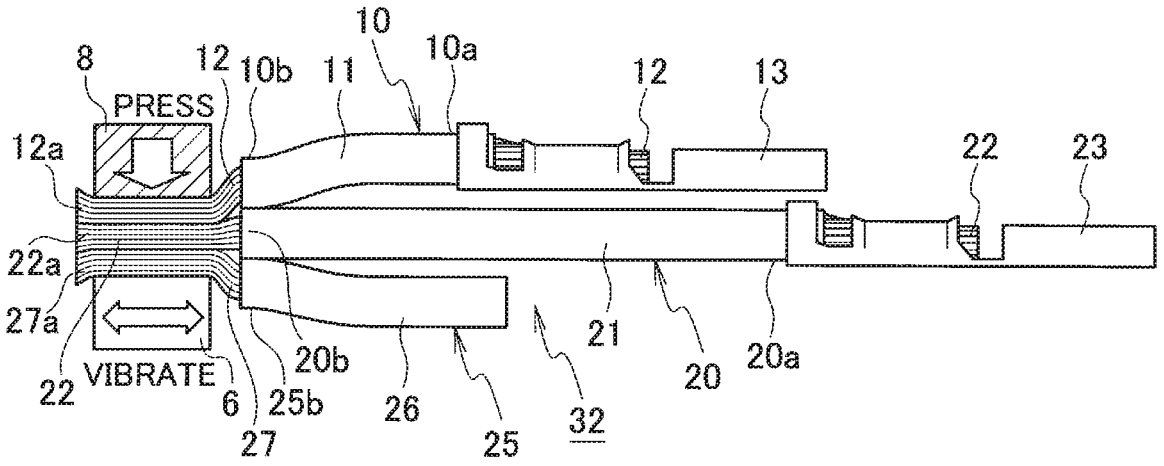
FIG. 9 is a sectional view taken along line X-X of FIG. 8.
Figure 10A:
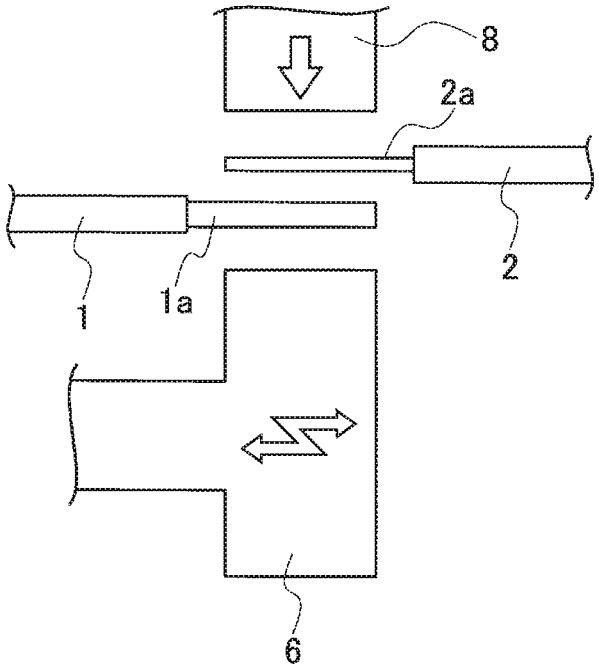
FIG. 10A is a schematic view of main portions in temporary bonding in a conventional wire bonding method.
Figure 10B:
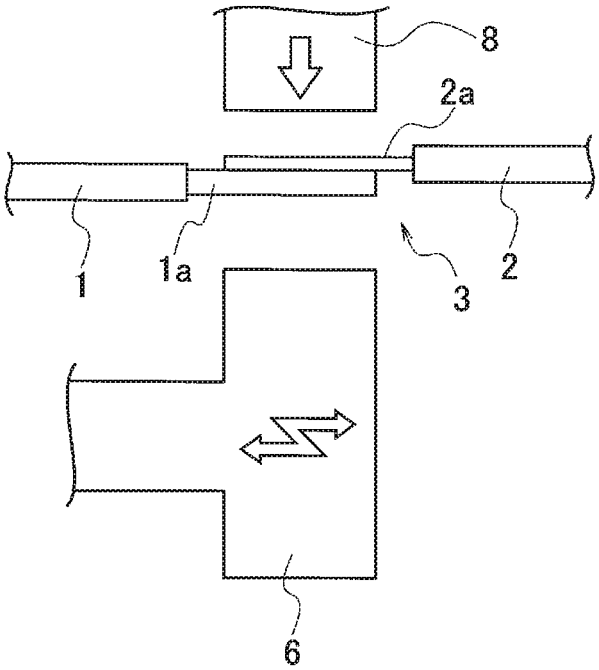
FIG. 10B is a schematic view of the main portions in bonding.

FIG. 8 is a front view of two different-length terminal-wires and a dummy wire bonded together between a horn and an anvil in an ultrasonic bonder used in a terminal-wire bonding method according to a third embodiment of the present invention. FIG. 9 is a sectional view taken along line X-X of FIG. 8.

The terminal-wire bonding method according to the third embodiment is different from that according to the first embodiment in that a core 27 including a plurality of strands 27*a* exposed from an insulating sheath 26 at a second end 25*b* of the dummy wire 25 for damping ultrasonic vibration from the horn 6 to the first terminal-wire 10 and the second terminal-wire 20, is arranged on the side of the horn 6 with respect to a second core 22 at a second end 20*b*, for ultrasonic bonding. Note that the other configurations are similar to those according to the first embodiment. Thus, the same constituent elements are denoted with the same reference signs, and the detailed descriptions thereof will be omitted.

The terminal-wire bonding method according to the third embodiment will be described. At setting, the core 27 exposed from the insulating sheath 26 of the dummy wire 25 for damping propagation of ultrasonic vibration from the horn 6 to the first terminal-wire 10 shorter in wire length and the second terminal-wire 20 longer in wire length, is arranged intermixedly on the side of the horn 6 with respect to the second core 22 at the second end 20*b* of the second terminal-wire 20 longer in wire length. At bonding, a first core 12 at a second end 10*b*, the second core 22 at the second end 20*b*, and the core 27 of the dummy wire 25 are bonded together by ultrasonic bonding between the horn 6 and the anvil 8. Thus, a bonded terminal-wire 32 illustrated in FIG. 9 is completed, and function and effect similar to those according to the first embodiment are achieved. In particular, bonding can be performed with as small damage as possible to the first terminal-wire 10 shorter in wire length and the second terminal-wire 20 longer in wire length. Even when vibration propagates to crimp terminals 13 and 23 at first ends 10*a* and 20*a* of the first and second wires 10 and 20, the crimp terminals 13 and 23 can be reliably inhibited from breaking.

Note that, according to each embodiment, the core exposed from the insulating sheath at the first end of each wire is connected with the terminal by crimping. However, the core and the terminal may be connected together by, for example, ultrasonic bonding, laser bonding, resistance bonding, or electromagnetic welding.

According to each embodiment, after connecting the terminal with the core exposed from the insulating sheath at the first end of each wire, the cores at the second ends of the two different-length wires are boned together by ultrasonic bonding. However, after bonding the cores at the second ends of the two different-length wires together by ultrasonic bonding, the core exposed from the insulating sheath at the first end of each of the two different-length wires may be connected with the terminal by, for example, crimping.

Furthermore, according to each embodiment, the wires having the respective cores identical in material are bonded together, but the wires having the respective cores different in material may be bonded together. For example, in a case where a copper (Cu) wire and an aluminum (Al) wire are bonded together, the Cu wire is arranged on the side of the horn for bonding. Furthermore, the number of wires is not limited to two. For example, in a case where three wires of two thin Cu wires and one thick Al wire are bonded together, each thin Cu wire is arranged on the side of the horn for bonding.

What is claimed is:

1. A terminal-wire bonding method with a first terminal-wire and a second terminal-wire, the first terminal-wire having a first terminal connected with a first core exposed from an insulating sheath at a first end, the first core being exposed from the insulating sheath at a second end of the first terminal-wire, the second terminal-wire having a second terminal connected with a second core exposed, at a first end, from an insulating sheath longer than the insulating sheath of the first terminal-wire, the second core being exposed from the insulating sheath longer than the insulating sheath of the first terminal-wire, at a second end of the second terminal-wire, the terminal-wire bonding method comprising:

arranging the second core at the second end onto a side of a horn for ultrasonic bonding and the first core at the second end onto a side of an anvil for ultrasonic bonding; and bonding the first core at the second end and the second core at the second end together by ultrasonic bonding between the horn and the anvil.

2. The terminal-wire bonding method according to claim 1, wherein the arranging includes arranging the second core exposed by intermediate peeling of the insulating sheath of the second terminal-wire longer than the insulating sheath of the first terminal-wire, onto the side of the horn and the first core exposed from the insulating sheath at the second end of the first terminal-wire, onto the side of the anvil, and the bonding includes bonding the second core exposed by the intermediate peeling of the insulating sheath of the second terminal-wire longer than the insulating sheath of the first terminal-wire and the first core exposed from the insulating sheath at the second end of the first terminal-wire together by ultrasonic bonding between the horn and the anvil.

3. The terminal-wire bonding method according to claim 1, wherein the arranging includes arranging a core exposed from an insulating sheath of a dummy wire, onto the side of the horn with respect to the second core at the second end, and the bonding includes bonding the first core at the second end, the second core at the second end, and the core of the dummy wire together by ultrasonic bonding between the horn and the anvil.

4. The terminal-wire bonding method according to claim 1, wherein the first core and the second core each include a plurality of strands identical in thickness, and the first core and the second core are identical in sectional area.

5. The terminal-wire bonding method according to claim 2, wherein the first core and the second core each include a plurality of strands identical in thickness, and the first core and the second core are identical in sectional area.

6. The terminal-wire bonding method according to claim 3, wherein the first core and the second core each include a plurality of strands identical in thickness, and the first core and the second core are identical in sectional area.

7. A bonded terminal-wire comprising:

a first terminal-wire having a first terminal connected with a first core including a plurality of strands exposed from an insulating sheath at a first end, the first core being exposed from the insulating sheath at a second end of the first terminal-wire; and a second terminal-wire having a second terminal connected with a second core including a plurality of strands exposed, at a first end, from an insulating sheath longer than the insulating sheath of the first terminal-wire, the plurality of strands each being identical in thickness to each strand of the first core, the second core being exposed from the insulating sheath longer than the insulating sheath of the first terminal-wire, at a second end of the second terminal-wire, wherein the first core at the second end and the second core at the second end are bonded together by ultrasonic bonding between a horn and an anvil for ultrasonic bonding with the second core at the second end arranged on a side of the horn and the first core at the second end arranged on a side of the anvil, and the plurality of strands of the second core at the second end on the side of the horn is bonded with collapse stronger than collapse of the plurality of strands of the first core at the second end on the side of the anvil.

8. The terminal wire bonding method according to claim 1, wherein the horn is located on a lower side of the second ends of the first and second cores, and the anvil is located on an upper side of the second ends of the first and second cores.

9. A bonded terminal wire according to claim 7, wherein the horn is located on a lower side of the second ends of the first and second cores, and the anvil is located on an upper side of the second ends of the first and second cores.

* * * * *